US012453887B2

(12) United States Patent
Specht

(10) Patent No.: US 12,453,887 B2
(45) Date of Patent: Oct. 28, 2025

(54) EXERCISE AND REHABILITATION BAR

(71) Applicant: Active Ortho, Inc., Swansea, MA (US)

(72) Inventor: Gregory H. Specht, Bristol, RI (US)

( * ) Notice: Subject to any disclaimer, the term of this patent is extended or adjusted under 35 U.S.C. 154(b) by 124 days.

(21) Appl. No.: 18/606,388

(22) Filed: Mar. 15, 2024

(65) Prior Publication Data

US 2024/0307733 A1 Sep. 19, 2024

Related U.S. Application Data

(60) Provisional application No. 63/452,860, filed on Mar. 17, 2023.

(51) Int. Cl.
*A63B 21/00* (2006.01)

(52) U.S. Cl.
CPC ..... *A63B 21/4035* (2015.10); *A63B 21/153* (2013.01); *A63B 2213/00* (2013.01)

(58) Field of Classification Search
CPC ..... A63B 21/0442; A63B 21/0552; A63B 21/072; A63B 21/0722; A63B 21/08; A63B 21/15; A63B 21/4035; A63B 21/4043; A63B 23/1209; A63B 2213/00; A63B 2225/09
See application file for complete search history.

(56) References Cited

U.S. PATENT DOCUMENTS 1,714,391 A * 5/1929 Mcwhirter ..... A63B 21/015 482/148
4,257,591 A * 3/1981 Evans, Sr. ..... A63B 23/0211 482/91
4,517,966 A * 5/1985 von Othegraven .... A63B 21/05 606/241
5,190,512 A * 3/1993 Curran ..... A63B 23/00 482/125
5,643,161 A * 7/1997 Gordon ..... A63B 21/045 482/122
5,820,520 A * 10/1998 Sieber ..... A63B 23/0227 482/148
6,193,638 B1 * 2/2001 Barrett ..... A63B 21/0004 482/121
6,447,434 B1 * 9/2002 Waters ..... A63B 21/28 482/52
8,142,337 B2 * 3/2012 Hall ..... A63B 21/0552 482/904
10,022,578 B2 * 7/2018 Kelly ..... A63B 21/4033
11,077,337 B1 * 8/2021 Majkrzak ..... A63B 23/02
(Continued)

FOREIGN PATENT DOCUMENTS

KR 102263354 B1 * 6/2021 ..... A63B 21/0557

OTHER PUBLICATIONS

Michael L. Voight, The chop and lift reconsidered: integrating neuromuscular principles into orthopedic and sports rehabilitation, North American Journal of Sports Physical Therapy, Aug. 2008, vol. 3 No. 3 pp. 151-159, published in U.S.

*Primary Examiner* — Gary D Urbiel Goldner
(74) *Attorney, Agent, or Firm* — Nathanial P. Potter

(57) ABSTRACT

An exercise and rehabilitation bar that provides the user with a variety of attachments and features allowing the user to perform many exercises that focus on rotational movements that strengthen the user's torso, back, shoulders, and core without overly straining the user's hands, wrists, arms, shoulders, or other body part.

14 Claims, 3 Drawing Sheets

(56) References Cited

U.S. PATENT DOCUMENTS

| | | | | |
|---|---|---|---|---|
| 11,628,327 | B1 * | 4/2023 | Roberson | A63B 21/075 482/93 |
| 11,918,858 | B2 * | 3/2024 | Agrawal | A63B 71/0054 |
| 12,186,619 | B1 * | 1/2025 | Smith, Jr. | A63B 21/04 |
| 2002/0137599 | A1 * | 9/2002 | Kuo | A63B 23/14 482/45 |
| 2003/0109324 | A1 * | 6/2003 | Novotny | A63B 69/3623 473/257 |
| 2004/0185990 | A1 | 9/2004 | Orescan | |
| 2005/0181914 | A1 * | 8/2005 | Radkowski | A63B 69/22 482/907 |
| 2006/0058165 | A1 | 3/2006 | Dise | |
| 2006/0089239 | A1 * | 4/2006 | Davies, III | A61H 1/02 482/148 |
| 2006/0160463 | A1 * | 7/2006 | Orr | A63B 15/00 984/258 |
| 2009/0280965 | A1 * | 11/2009 | Shapiro | A63B 69/06 482/72 |
| 2010/0173760 | A1 * | 7/2010 | Hall | A63B 23/03525 482/129 |
| 2011/0143891 | A1 * | 6/2011 | Brennan | A63B 21/04 482/106 |
| 2011/0245051 | A1 * | 10/2011 | Emick | A63B 21/4035 482/139 |
| 2013/0012851 | A1 * | 1/2013 | Fahmie | A61H 7/003 601/119 |
| 2013/0225375 | A1 * | 8/2013 | Lumsden | A63B 21/0051 482/72 |
| 2016/0095397 | A1 * | 4/2016 | Crowhurst | A45B 9/00 135/77 |
| 2017/0021219 | A1 * | 1/2017 | Kelly | A63B 21/4033 |
| 2024/0299800 | A1 * | 9/2024 | Bardunias | A63B 23/1281 |

* cited by examiner

EXERCISE AND REHABILITATION BAR

FIELD OF THE INVENTION

The present invention generally relates to exercise and rehabilitation devices. More particularly, the present invention relates to an exercise and rehabilitation bar having an elongated shaft with attachments on both distal ends including at least one handle having a portion that is perpendicular to the plane along the greatest length of the bar, the at least one handle being hollow to receive connectors for weights, tethers, cables, and/or equipment, and the exercise and rehabilitation bar being a piece of equipment that allows a patient or user to perform a variety of exercises and movements that provide different levels of impact on the patient's skeletal and muscular systems.

BACKGROUND OF THE INVENTION

In the rehabilitation industry, patients are typically guided by a medical professional, such as a physical therapist, through movements and exercises that help coordinate the musculature surrounding joints. These movements and exercises are an effort to improve strength and/or flexibility, or alleviate stress experienced by muscles, ligaments, and tendons that may occur due to inefficient biomechanics, muscular tension, atrophy, injury, or illness.

Rehabilitative exercise is generally restricted by patient limitations (such as body weight, strength, flexibility, joint mobility, pain, injury, and dynamic proportions) and available equipment such as resistance and movement devices. Resistance devices include discrete weight bundles (i.e., dumbbells and other free weight devices) and resistance devices (including resistance bands, adjustable weights on connecting tethers or cables, or other devices which associate with universal uses) which generally includes the commonly referred smith-type machines (guided squat and shoulder press), angled guided presses (chest, shoulder and leg), angled guided pulls (back and leg), and typical arm strengthening machines (triceps, biceps and forearms).

There is sometimes a need for specialized exercise and rehabilitation devices that are designed to allow a patient (or "user" if the individual is not a formal patient under treatment) to perform certain movements or exercises that are difficult for the patient due to the resistance provided by the weight or resistance band and/or the complexity of the movement. Commonly, these movements or exercises involve the emulation of movements anyone may perform in their daily life. An example of such complex movements is when the patient manipulates the resistance in more than one planar direction (such as the patient pulling a weight backwards, to one side, and downwards similar to paddling with a paddle in a canoe) or shoveling with a shovel. These specialized movements (such as chopping, paddling, shoveling, and lifting motions) are useful not only for rehabilitation and/or exercise, but to identify weak muscle groups or other issues presented by the patient to be observed by a medial professional.

The "Neer Impingement Test" is a classic provocative test for "Shoulder Impingement Syndrome", and it is performed in the same position that most people will use with their arm in a higher position, when performing a chopping or lifting exercise with a traditional straight bar. Shoulder Impingement Syndrome is believed to be the most common cause of shoulder pain, accounting for 44% to 65% of all shoulder complaints (according to publicly available peer-reviewed studies published as recently as January 2024). The advantage of using the present invention is to avoid the challenging and often painful impingement positions. This provides advantages for a large number of people who require performing exercises like chopping motions and lifting motions but are unable to do it with a straight bar secondary to impingement syndrome which is exacerbated in the stated positions.

Some devices exist to provide patients with less strain while performing these movements or exercises but there is a need for a device that allows patients to perform certain rehabilitative exercises. Alternatively, in some contexts, there is a need for a device that allows the user (who may be a patient or an individual seeking to strength strain) to exert increasing levels of rotational force or torque with user's torso while minimizing the impact on the patient's joints, tendons, muscles, and/or bones. Further, some exercises place greater resistance and/or strain on a patient's hands, wrists, and/or arms, limiting the amount of resistance that the patient may desire to use, or be capable of using, when exercising the patient's torso, legs, and/or core. Therefore, there is a need for a versatile exercise and rehabilitation bar with at least one specialized handle which allows the user to perform complex movements to focus on the user's torso, legs, and/or core while limiting the strain on the patient's hands, wrists, shoulders, and/or arms to alleviate or prevent common shoulder and other problems associated with using a straight bar. Finally, while the foregoing describes the use of a specialized exercise and rehabilitation bar by a patient seeking rehabilitative treatment, it should also be appreciated and understood that such a device provides a litany of benefits for users (who are not patients) seeking to improve their strength, muscular and/or skeletal stability, posture, and/or fine motor movements (such as a golf swing) by using the device.

SUMMARY OF THE INVENTION

The following presents a simplified summary of the present invention to provide a basic understanding of the invention's concepts. This summary is not an extensive overview, and it is not intended to identify critical elements or to limit the scope of this disclosure. The sole purpose of this summary is to present some general concepts in a simplified form as a prelude to the detailed description of the invention.

The subject matter disclosed and claimed herein, in some embodiments of the present invention, relates to an exercise and rehabilitation bar comprising an elongated shaft having two distal ends wherein each distal end has a receiving structure that is adapted to receive at least one attachment; a first attachment comprising a handle connected via an attachment mechanism at one distal end of the elongated shaft, wherein the handle comprises a "T-shape" and the top of the "T-shape" is aligned perpendicular to the plane along the greatest length of the elongated shaft when the handle is connected via a first receiving structure, and wherein the top of the "T-shape" comprises a hollow interior portion; a second attachment connected via a second attachment mechanism to the opposite distal end of the elongated shaft in relation to the first attachment; and wherein at least one of the attachments are engaged with a resistance mechanism.

To the accomplishment of the foregoing and related ends, certain illustrative aspects of the disclosed innovation are described herein in connection with the following description and the annexed drawings. These aspects are indicative of only a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The embodiments of the present invention disclosed herein are illustrated by way of example, and not by way of limitation, in the figures of the accompanying drawings, in which like reference numerals may refer to similar elements.

DETAILED DESCRIPTION OF THE PRESENT INVENTION

Figure 1:
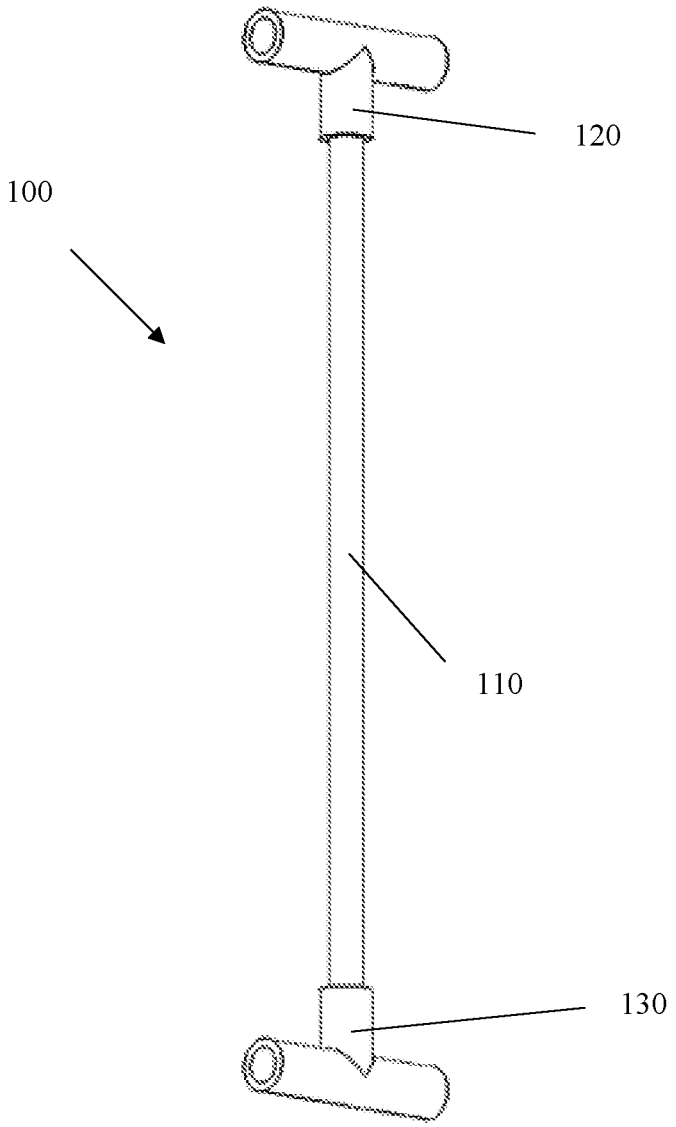
FIG. 1 provides an exemplary embodiment of the present invention in an isometric view.

The innovation is now described with reference to the drawings, wherein reference numerals are used to refer to elements throughout. In the following description, for purposes of explanation, numerous specific details are set forth to provide a thorough understanding of the present invention. It may be evident that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a need for a versatile exercise and rehabilitation bar which allows the patient or user (hereafter "user" in the singular or collectively "users") to perform complex movements that focus on the user's torso, legs, and/or core while limiting the strain on the user's hands, wrists, and/or arms. Put another way, there is a need for an exercise and rehabilitation bar that focuses on enabling users to perform rotational movements or exercises while reducing the stress, tension, and/or pain on the user's hands, wrists, arms, shoulders, and/or other body parts. Current solutions to the needs of users are not thoroughly met by devices and methods that lack the versatility of the present invention. For example, exercise and rehabilitation bars exist but they do not provide users with the features provided by the present invention.

Namely, the present invention allows for a variety of grips, bar length, resistance location, connection methods, and movements which allows users to perform movements and exercises with improved biomechanical efficiency, a lower likelihood of injury, and the use of healthier joint mechanics. Particularly, the present invention is ideal for complex movements and exercises that employ the torque power and stability of the user such as chop and lift movements, golf swings, baseball bat swings, some boxing or other contact sport techniques, other hitting motions, shoveling movements, sweeping movements, and more.

FIG. 1 provides an exemplary embodiment of the present invention in an isometric view. In some embodiments, an exercise and rehabilitation bar 100 is comprised of an elongated shaft 110 having two distal ends each with a receiving structure designed to couple with at least one attachment, a first attachment 120 (depicted as a "T-shaped" handle in this embodiment) coupled to the elongated shaft 110 at a first receiving structure, and a second attachment 130 (depicted as a "T-shaped" handle in this embodiment) coupled to the elongated shaft 110 at a second receiving structure that is located on the opposite distal end relative to the first receiving structure. A resistance mechanism having at least one connection mechanism such as a tether (which may employ at least one of a variety of locking mechanisms such as a hook on the end of the tether that loops into a hole or other receiver at a different spot on the tether) or cable, at least one resistance band, at least one weight, at least one exercise machine, at least one air pressure resistance machine, at least one securing mechanism for the band or weight, and combinations thereof are attached to the exercise and rehabilitation bar 100 prior to the user exercising and/or moving the exercise and rehabilitation bar 100. The resistance mechanism may attach to the exercise and rehabilitation bar 100 through a variety of ways including attaching directly to a receiving structure or via at least one of the attachments.

In some embodiments, the elongated shaft 110 may include an extension mechanism allowing a user to set the elongated shaft 110 to a desired length. The extension mechanism may involve common mechanisms used in exercise and rehabilitation equipment such as rails with shaft locking mechanisms and/or hole-and-pin connections to secure the elongated shaft 110 at the desired length. Alternative extension mechanisms include tension rods which are twisted to secure the shaft at a desired length. Further, those skilled in the art will appreciate that any extension mechanism will suffice so long as it fully secures the elongated shaft 110 at the desired length without worry of undesired disengagement of the shaft locking mechanism during use possibly resulting in harm to the user. In some embodiments, the extension mechanism allows the length of the elongated shaft 110 to lock between twelve inches and fifty inches, providing users with the ability to grip the exercise and rehabilitation bar 100 in a variety of positions to allow for a variety of exercises and movements engaging different parts of the user's torso, back, shoulders, core, etc. In some embodiments directed to shorter user's or specific grip configurations, the elongated shaft may have a minimum adjustable length as small as about four inches. In alternative embodiments, the elongated shaft 110 may be adjustable to lengths over fifty inches as to better resemble a pole or oar for certain movements or exercises.

In desirable embodiments, the elongated shaft 110 should have sufficient resistance to bending and/or warping during use with resistance mechanism(s) as the user increases the amount of resistance and/or weight used in the movements or exercises.

In further embodiments, the elongated shaft 110 may be operably constructed of multiple segments that allow for rotation instead of, or in addition to, the extension or telescoping mechanism(s). In one such constructure, a first segment of the elongated shaft 110 may have a portion that is interior to a second segment of the elongated shaft 110. Further, the first segment may include a protruding portion about its circumference and on its exterior of the portion of the first segment which is inserted into the second segment. The second segment may have an interior grove adapted to fit the protruding portion of the first segment as to allow the first segment to rotate but not allow the first segment to be pulled out of the second segment because the protruding portion fits within the groove but not the interior of the second segment. Further embodiments may prefer to use ball bearings wherein an outer ring of the bearing is attached to the second segment and an inner ring of the bearing is attached to the first segment.

In some embodiments, attachments (such as the first attachment 120 and the second attachment 130) include grippable structures such as handles, hooks, loops, and stirrups, and other connecting pieces such as one part for coupling the elongated shaft 110 to a pivot mechanism, resistance mechanisms. In the depicted embodiment, the first attachment 120 and the second attachment 130 are both handles that align perpendicular to the plane of the greatest length of the elongated shaft 110 and form "T-shaped" handles. The bottom of the "T-shaped" handles includes an attachment mechanism which connects that handle to the elongated shaft 110 at one of the elongated shaft's 110 receiving structures. The handle may connect with one of the receiving structures via a variety of suitable methods include screwing on via screw threads on one piece (ex. the first attachment 120) and a screw thread receiver on the other piece (ex. being on the end of the elongated shaft 110), at least one hole-and-pin securing mechanism, a twisting and/or tension securing mechanism, a spring lock such as a spring plunger, the pieces may connect via a snug fit wherein the elongated shaft 110 inserts far enough into the handle having a sufficiently long enough base to where the elongated shaft 110 does not slip out of the handle during use, and similar mechanisms and methods. In some embodiments, attachments may include additional receiving structures like the receiving structures of the elongated shaft 110. This allows for attachments to be connected in succession and allows for a variety of functional aspects to be added to the rehabilitation and exercise bar 100 via these attachments. For example, the receiving structure of the elongated bar 110 may be coupled with an attachment for holding a weight plate, weight disc, dumbbell, etc. (maybe as simple as being comprised as a shaft for receiving the weight plate via the hole in its center, a platform to hold the weight plate, and a securing mechanism for the weight plate) that also has its own receiving structure that the user may couple with another attachment such as a handle.

In alternative embodiments, one or both of the attachments may be permanently affixed to the elongated shaft 110.

One benefit of embodiments having handles on both distal ends of the elongated shaft 110 is that this will allow observers to monitor the user while they perform movements or exercises in various grips (such as grabbing the top of the "T-shaped" handle in an almost false grip motion (wrapping hand around the bar so that the wrist is placed over the bar), a full grip, an asymmetrical or directional palm grip, a symmetrical or freestyle grip, and other specialized grips) while having the resistance mechanism coupled to the bottom or top of the exercise and rehabilitation bar 100. This change in resistance location and grip configuration may better allow observers to identify core and/or torque deficiencies, weak performance areas, musculoskeletal compensations for movements or exercises, stability, and strength. Having this more informed position further allows observers to recommend targeted exercises and resistance amounts to promote the user's increase in desired attribute (such as strength, stability, and/or biomechanical motion).

In the depicted embodiment, both handles have hollow interiors through the top of the "T-shape" which allows connection mechanisms such as tethers to be looped through the interior of the handle. Then, the user may lock the tether so that it does not undesirably detach during use. The tether may lock by being tied, buckled, connected via a hook and loop, or other suitable method. The tether is attached to a resistance mechanism such as a resistance band or weight. The tether and resistance mechanism may be part of a pulley system that pulls the resistance band in a direction (such as upward) when the user manipulates the exercise and rehabilitation bar 100. Further, this setup provides a variety of actions and points of resistance as the user performs different movements or exercises.

For example, the user may face the weight machine comprising a pulley system with the resistance mechanism and attach the tether to the exercise and rehabilitation bar 100, place the tethered end of the exercise and rehabilitation bar 100 towards the ground, grab the untethered handle with one hand and the elongated shaft 110 with another hand, and perform a rowing or paddling exercise where the tether on the bottom applies resistance as the user manipulates the exercise and rehabilitation bar 100 in a method similar to a paddle. The user may further augment their exercise by adjusting how they are engaging the resistance. For example, in one paddling motion, the user may use their hand on the top of the bar, on the "T-shaped" handle, to exert almost all the force necessary to perform the motion. This allows the user to use their other hand (or bottom hand which grips the elongated shaft 110 instead of the "T-shaped" handle) as a guide and stabilizer for the motion. Or the user may switch which hand is performing which action (the top hand serves as a guide and the bottom hand is "pushing" the bar upwards to simulate a shoveling motion).

Alternative to the preceding setup, the user may face away from the weight machine, keep the tethered handle towards the ceiling, position both hands on the elongated shaft 110, and perform movements such as chopping up and down like when using an axe to chop wood or twisting the torso and body like when swinging a baseball bat. Those skilled in the art will appreciate that while only a few movements and/or exercises have been described, the uniqueness of the present invention is in its ability to allow the user to apply a multiple of grips and configurations.

In alternative embodiments to the depicted embodiment, only one of the handles may have a hollow interior. This embodiment allows additional weight to be in the non-hollow handle which may be desirable for certain exercises.

In some embodiments, the elongated shaft 110 and/or the attachments 120, 130 may include non-slip and/or ergonomic grips to aid the user in grip strength, stability, or to relieve discomfort or pain while performing exercises using the present invention. These grips may be particularly appreciated by user's rehabilitating handle, wrist, and/or arm injuries or illness by removing strain from the relevant parts of the user's body. Further, any part of the exercise and rehabilitation bar 100 that is designed to be gripped by the user may include ridges, grooves, imprints, or other alterations that aid the user's grip and comfort when using the invention.

It will be appreciated by those skilled in the art that the exercise and rehabilitation bar 100 should be made of a variety of materials including metal, rubber, plastic, and fabric. The focus in designing any exercise and rehabilitation bar 100 is on the durability and rigidity of the invention, which is necessary when dealing with variable amounts of resistance mechanisms that may be used with the invention, balanced against the user's comfort in implementing the invention in the user's exercises and/or movements. Particularly, the elongated shaft 110 benefits from being made of durable and rigid materials and any part of the exercise and rehabilitation bar 100 that contacts the user (such as a handle as the first attachment 120 or a sleeve on the elongated shaft 110) may be made of materials that provide a more secure grip such as rubber and/or fabric.

The exercise and rehabilitation bar 100 may be offered to users (from rehabilitation patients to weightlifters) in a variety of embodiments designed specifically for their appropriate rehabilitative exercise or strength training purposes. For example, an exercise and rehabilitation bar 100 specifically designed for rehabilitative exercises may be made of lighter materials and only designed to operate with weights ranging from 2 to 25 pounds. This embodiment would require less material, such as metal or plastic reinforced with metal rods making up the shaft and will therefore weigh less and be easier for a rehabilitation patient to set up and operate without aid from a physical therapist, other rehabilitation specialist, or assistant. Of course, heavier versions may be used for users wishing to use the exercise and rehabilitation bar 100 for strength training purposes.

In some embodiments, the exercise and rehabilitation bar 100 may be designed to provide additional comfort to the user as the user performs a large number of repetitions of one or more movements and/or exercises. Such embodiments may forgo rigidity for the sake of being lighter in weight. Further, such embodiments may implore specialized grip textures, wrappings, or configurations in addition to other specialized elements focused on providing comfort and encouraging higher numbers of repetitions to the user.

In alternative embodiments, the exercise and rehabilitation bar 100 may be more rigid and heavy as to be specialized for higher resistances and use by individuals seeking to build muscle in addition to gaining the torque and stabilization created by repeated use of the present invention.

In even further embodiments, the exercise and rehabilitation bar 100 may fall within a "middle ground" between the lighter weight and heavier duty embodiments described in the preceding sentences. This middle group device is desirable by users seeking to begin by building healthier joints, torque power, and stability and may proceed with desiring to build even greater strength and technique.

Figure 2:
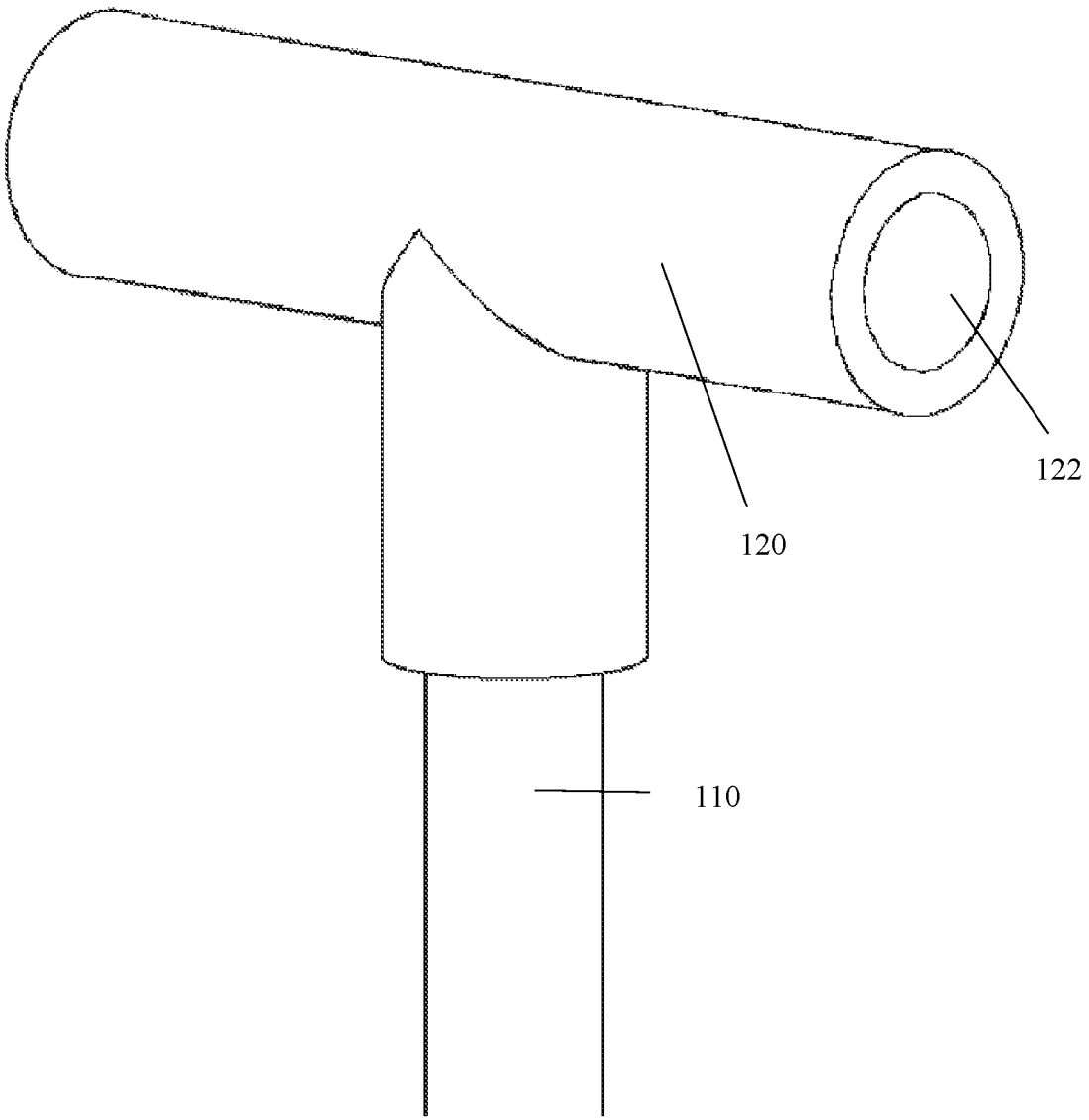
FIG. 2 provides a close-up of an exemplary embodiment of a "T-shaped" handle that is part of the present invention in an isometric view.

FIG. 2 provides a close-up of an exemplary embodiment of a "T-shaped" handle that is part of the present invention in an isometric view. The depicted embodiment prominently displays the first attachment 120 in the form of a handle that is coupled to the elongated shaft 110. This handle forms a generally perpendicular angle with the plane created by the greatest length of the elongated shaft 110. In alternative embodiments of the present invention, the "T-shaped" handle includes a pivot that allows the top portion of the "T-shape" to change its angle (besides the default 90 degree angle) to allow the user to employ a variety of grip configurations.

Further, in some embodiments, the handle should be sufficiently wide along the top of the "T-shape" to allow for a variety of grips by the user such as the user only griping the left or right portion of the top of the "T-shaped" handle or any other grip where the user's hand(s) engage the handle in a desired way. In some embodiments the length of the top of the "T-shaped" handle is about 6 inches. In alternative embodiments, the "T-shaped" handle may be wide enough as to allow the user to place both their hands along the top portion of the "T."

The "T-shaped" handle provides many benefits to users in both exercise and rehabilitation settings. This is partially due to the form and comfort of gripping the "T-shaped" handle allowing the user to keep their hand aligned parallel-with-the-floor when the elongated shaft is predominantly in a perpendicular-to-the-floor position or "standing" position. This position allows for the user's wrist to feel a more evenly distributed amount of pressure compared to grip orientations where the user's hand would be holding the bar and/or grip an upright position. This position allows for the resistance created by the exercise to more evenly distributed amongst the user's wrist and carpal bones, reducing common wrist injuries such as sprains, tendonitis, fractures, and dislocations. Further, the user may use different grip orientations with the "T-shaped" handle to aid in grip strength, comfort, or to allow for certain exercises that the user cannot otherwise safely and/or comfortably perform.

Figure 3:
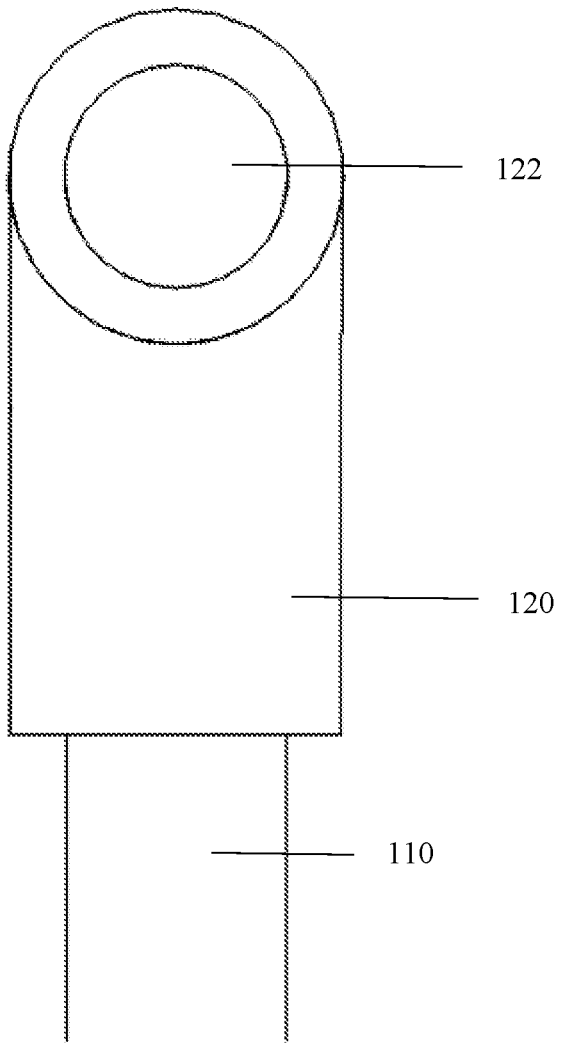
FIG. 3 provides another angle of the handle of FIG. 2 from an angle prominently showing the handle's hollow interior.

FIG. 3 provides another angle of the handle of FIG. 2 from an angle prominently showing the handle's hollow interior. The depicted embodiment displays a handle that is hollow with sufficient thickness as to not allow the handle to deform or be damaged during use. It should be appreciated by those skilled in the art that, in some embodiments, a handle made of metal with a rubberized exterior will provide a sufficiently durable and rigid handle while also providing the user with a slip-resistant and comfortable grip. Further, the handle may include securing mechanisms (including items such as straps, formed grips, and elastic bands) that help keep the user's hand engaged with the handle while not securing the user's hand to the handle so completely that injury could result from the user not being able to disengage their grip on the handle.

In alternative embodiments, the hollow interior portion of the handle may include the locking mechanism which secures the connection mechanism to the attachment (such as inside the interior portion of the handle in this example). One example of this embodiment is a metal loop (one embodiment being in the form of an eyelet) that is engaged by a metal hook at the end of a tether. This embodiment is merely an alternative to the connection mechanism looping through the hollow interior of the handle and securing to itself via the locking mechanism.

In some embodiments, the present invention is attached to an external or separate resistance mechanism comprising an assembly or structure, a means for increasing the resistance, an arm that may be secured at a variety of heights and/or angles, and a tether capable of being coupled to the present invention while also being attached to the means for increasing resistance through or along the arm. The assembly or structure (upright or otherwise) may be of variety of specialized or common gym equipment such as smith machines, pulleys, lat pull down machines, functional trainer machines, cable cross machines, and the like. The assembly or structure may be standalone, attached to an infrastructure piece such as a wall or pillar, or it may be attached to another assembly or structure. Resistance may be increased by adding additional weights, turning dials, increasing tension, or other common methods used for adjusting the weight or resistance of exercise equipment. The assembly or structure may stand upright on its own or it may be secured to a wall or other structure or assembly. The arm should be an adjustable (and possibly extendable) bar that may be secured at a variety of heights thanks to mechanisms such as a radial disc attached to the assembly with a plurality of holes that is secured by a pin or peg attached to the arm to secure the arm at the desired height and/or angle. The arm allows the user to adjust the height and angle of the resistance or weight.

One major benefit of the present invention that bears mentioning and repeating is the ability to place a tether or other resistance mechanism to or through the "T-shaped" handle. This places the point of weight/resistance in or near the user's grip (depending on their grip configuration) which allows the user to better control the weight/resistance. Put another way, the weight/resistance being within the hand of the user reduces forces that rival the user's control and stability. Further, if the weight/resistance were being focused on the opposite end of the elongated shaft from where the user's grip is engaged, small movements to the side, up, or down, may make a rehabilitating user lose control of the exercise and rehabilitation bar 100 during the exercise.

Additionally, the inclusion of the "T-shaped" handle allows the user to adjust the orientation of their entire arm and shoulder when performing exercises simply by adjusting how they grip the present invention. This allows for diagnosis, safety, and better training. Finally, the present invention allows the user to apply greater speed and forces during exercises than could be performed with a typical "straight bar" which allows for more efficient movement patterns for the hands, shoulders, and arms. In all, the present invention allows for more natural movements than traditionally used, similar equipment such as a straight bar.

More specifically, regarding current technologies, when performing chopping motions (pushing down diagonally across the body) or lifting motions (lifting up diagonally across the body) with a conventional straight bar, the shoulder of the user's arm that is in a high position will typically be in a position of extreme internal rotation while it is being lifted overhead either passively when returning the arms upward after performing a downward chopping motion or when actively elevating the arms during a lifting motion. This internal rotated position of the user's shoulder while the arm is elevating is well known by orthopedic medicine and rehabilitation professionals as an "impingement position" of the shoulder because it is in this position that the humeral head impinges upward on the undersurface of the acromion which "pinches" the internal structures of the shoulder joint, including the supraspinatus tendon and the subacromial bursa. This is an unnatural position for the shoulder to perform repeated movements and is often painful for users who experience shoulder pain.

In a first exemplary exercise using the present invention, the user secures a tether connected to a resistance band or weight to the second attachment 130 (or the bottom attachment in this scenario) of the exercise and rehabilitation bar 100. This tether may be part of a simply pulley system or other common gym equipment, or it may be part of a standalone apparatus that is paired with the present invention. Then, the user positions themselves facing the direction of the tether and band/weight. Next, the user aligns their grip orientation with one hand across the top of the first attachment 120 such a "T-shaped" handle and their other hand about two-thirds down from the top of the elongated shaft 110 simulating the orientation of a paddle or oar used when boating in a vessel such as a canoe. Finally, the user may begin the exercise by "paddling" the exercise and rehabilitation bar 100 on either side of their body either all on one side or in an alternating pattern of some kind. This exercise simulates the effect of a "paddling" on the user because the tension, weight, or force is located at the bottom of the elongated shaft 110 much like the bottom of a paddle or oar would be where someone paddling a canoe would feel the weight or resistance of trying to displace water to move the vessel. The user may easily augment the amount of force required to "paddling" the bar, where the user feels the resistance felt during the exercise, the amount of weight/tension used, the angle of resistance, and whether and/or how rotational force is applied during the exercise by several ways. As some examples of variations that could affect the impact and effect that the exercise has on the user: (1) the user could stand closer to the source of the tether so that there is slack in the tether until the user reaches a certain point in the user's "paddling" motion which would change the point in the movement where the user feels resistance possibly allowing for rehabilitating users to perform a movement they would otherwise not be able to with any resistance from the exercise device; (2) the user could add more torso rotation as to target different muscle groups than a typical "paddle" motion; (3) the user may add additional weight to make the exercise more impactful on the user's muscles for strength training purposes; (4) the user could change their grip orientation on the exercise and rehabilitation bar 100 allowing the user to choke up or down on the shaft would change the amount and leverage of the resistance; (5) the user may stand, sit, kneel, or be in any other position as to limit the impact of the exercise on one part of the body and/or emphasize said impact on another part of the body; and so on. Generally, this "paddling" movement will be felt as a pulling movement and possibly a twisting movement on the user; however, simple alterations of position and/or orientation of the user or adjustments to the exercise and rehabilitation bar 100 and how it connects to the tether (or tethers) may provide a tremendous number of variations of workouts for the user.

In a second exemplary exercise using the present invention, the user sets up similar to the previous example; however, the user faces away from the direction of the source of the tether this time. This change in orientation makes the user engage in a "pushing" motion or "reverse paddling" motion instead of a "paddling" motion.

In a third exemplary exercise using the present invention, the user secures the tether to itself after passing it through the hollow interior of the handle on one end (serving as a "top end") of the exercise and rehabilitation bar 100. This should leave sufficient room for the user's hand to grip the "T-shaped" handle without rubbing against the tether. This position is advantageous because the user will feel the resistance or weight even distributed within their hand because the tether is attached through the handle. This removes some of the strain felt by the user when performing exercises. More specifically, the weight of the rehabilitation and exercise bar 100 would be felt by the user but the user would not feel any significant downward weight from the tether. This action lowers the impact the user will feel on their wrist, elbow, shoulder, and potentially other recovering muscular and/or skeletal structures.

In a fourth exemplary exercise using the present invention, the user secures the tether to itself after passing it through the hollow interior of the handle on one end (serving as a "top end") of the exercise and rehabilitation bar 100. Then, the user places the hand of their higher position arm on the "T-shaped" handle to push straight down perpendicular to the elongated shaft 110 allowing the shoulder of the upper arm to retain a more neutral rotated position to alleviate pain and avoid the impingement position. This also allows more force to be applied through the bar with the arms much like a canoe paddle is most forcefully manipulated with the hand of the downward pushing arm placed at the top end of the paddle for greater force production. Now, the user may face several directions from the source of the tether such as at a perpendicular angle or away from the source of the tether. Finally, the user may begin performing an overhead or cross body motion resembling using an axe to chop firewood from above in a predominantly vertical motion or a motion similar to using an axe to chop a standing tree in a predominantly horizontal motion. The present invention allows for positioning of body and hands during these motions to reduce pain felt and avoiding a provocative impingement position for the user's shoulder(s).

In a fifth exemplary exercise using the present invention, the exercise and rehabilitation bar 100 may be attached on each distal end to a set of parallel tethers (one tether attached to one distal end) roughly the same distance apart as the length of the exercise and rehabilitation bar 100. Then, the user may position themselves either standing, kneeling, or sitting, and wherein the bar is touching or slightly separated from the user's chest with a hand on either and each hand near one distal end of the exercise and rehabilitation bar 100. Now, the user may perform standing, kneeling, or sitting horizontal presses similar to bench presses using a barbell or dumbbell horizontal presses. This exercise could be used for rehabilitation or strength training depending on the user and the amount of resistance and/or weight attached to the tethers. Further, the exercise and rehabilitation bar 100 allows for a variety of hand placements and grips thanks to the attachments being interchangeable. For example, the user may secure two "T-shaped" attachments, one to either side, so that the user could maintain a vertical grip instead of a horizontal grip while performing the exercise. This change in grip is beneficial because some users may have difficulty maintaining a horizontal grip. Further, embodiments having an adjustable elongated shaft 110 would allow users to change the distance between their hands which allows for targeting of different muscle groups (such as triceps instead of biceps).

In a sixth exemplary embodiment using the present invention, two exercise and rehabilitation bars 100 may be secured to an apparatus with a seat between about the secured point of the bars forming a false canoe or rowboat setup. The bars may be secured about halfway up the length of their elongated shafts 110 as to simulate where a paddle or oar may be secured to a rowboat. This securement prevents the length of the elongated shaft 110 of each bar from undesirably moving through the securing mechanism. The bottom of bars may be attached to resistance mechanisms and the top of the bars will have some form of handle as their attachments. Even if this embodiment provides handles, the user may grip the upper portion of the elongated shaft 110 to perform the dual "row" exercise.

In a seventh exemplary embodiment using the present invention, the tether may be coming from a downward angle and looped through and secured to the handle of the present invention. The user places one hand on the bottom of the "T-shaped" handle (the one the connected to the tether) and the other handle on the elongated shaft 110. The present invention should be angled with the tethered handle downward and the other distal end of the exercise and rehabilitation bar 100 at a diagonal across the user's body; both palms are up in this configuration. Then, the user may push with the hand on the handle and guide with the other hand in a motion similar to slinging the contents of a shovel over their opposite shoulder in a torso rotating motion. This motion creates a more neutrally rotated position for the hand on the handle and avoids the impingement position. This also allows more force to be applied through the bar with the arms much like a snow shovel is most forcefully manipulated with the hand of the pushing arm placed at the end of the shovel to apply force through the elongated bar of the shovel for greater force production.

In all, the preceding examples explain how and why the user's hands, arms, and shoulders are able to handle and produce greater amounts of force when using the present invention. With greater force production capacity and comfort in the shoulders, arms and hands, more forceful and repetitive movements can be performed with the invention which results in a greater strength training effect on the rest of the body, including the core, torso, upper/lower back, and hips.

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, which is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods, systems, and apparatus described herein may be accomplished by appropriate modifications by one of ordinary skill in the art without departing from the scope of the present invention. Several such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An exercise and rehabilitation bar comprising:

an elongated shaft having first and second distal ends respectively comprising first and second receiving structures that are respectively adapted to receive first and second attachments;

the first attachment comprising a first handle connected via a first attachment mechanism at the first distal end of the elongated shaft, wherein the first handle comprises a first "T-shape" and a top of the first "T-shape" is aligned perpendicular to a plane along a greatest length of the elongated shaft when the first handle is connected via the first receiving structure, and wherein the top of the first "T-shape" comprises a first hollow interior portion;

the second attachment is capable of comprising a second handle connected via a second attachment mechanism at the second distal end of the elongated shaft, wherein the second handle comprises a second "T-shape" and a top of the second "T-shape" is aligned perpendicular to the plane along the greatest length of the elongated shaft when the second handle is connected via the second receiving structure;

wherein at least one of the first and second attachments are engaged with a resistance mechanism;

wherein at least one of the first and second handles is adjustable about a pivot to provide a different angle than a ninety degree angle created by a respective coupling of the at least one of the first and second handles and the elongated shaft; and wherein the first and second attachments are capable of being substantially equivalent.

2. The exercise and rehabilitation bar of claim 1, wherein a non-slip layer is wrapped around an exterior of the elongated shaft.

3. The exercise and rehabilitation bar of claim 1, wherein the top of the second "T-shape" of the second attachment comprises a second hollow interior portion.

4. The exercise and rehabilitation bar of claim 3, further comprising a first connection mechanism that is threaded through the first hollow interior portion of the first attachment and secured by a first locking mechanism and a second connection mechanism that is threaded through the second hollow interior portion of the second attachment and secured by a second locking mechanism.

5. The exercise and rehabilitation bar of claim 4, wherein the first connection mechanism and the second connection mechanism are tethers.

6. The exercise and rehabilitation bar of claim 1, further comprising a connection mechanism that is threaded through the first hollow interior portion of the first attachment and secured by a locking mechanism.

7. The exercise and rehabilitation bar of claim 6, wherein the connection mechanism is a tether.

8. The exercise and rehabilitation bar of claim 1, wherein the elongated shaft further comprises an extension mechanism for adjusting a length of the elongated shaft and a shaft locking mechanism to secure the elongated shaft at a desired length.

9. The exercise and rehabilitation bar of claim 8, wherein the elongated shaft has a minimum length of twelve inches and a maximum length of forty inches.

10. The exercise and rehabilitation bar of claim 1, wherein the second attachment is further capable of comprising a grippable structure selected from the group including a third handle, hooks, loops, and stirrups.

11. The exercise and rehabilitation bar of claim 1, wherein the first handle further comprises an ergonomic grip.

12. The exercise and rehabilitation bar of claim 1, wherein the resistance mechanism is selected from the group consisting of at least one tether, at least one resistance band, at least one weight, at least one weight plate, at least one weight disc, at least one dumbbell, at least one exercise machine, and combinations thereof.

13. The exercise and rehabilitation bar of claim 1, wherein at least one of the first attachment and the second attachment comprises an attachment having an additional receiving structure for respectively securing at least one additional attachment to the at least one of the first attachment and the second attachment.

14. The exercise and rehabilitation bar of claim 1, further comprising an external resistance mechanism comprising an assembly including an upright structure, a means for increasing the resistance, at least one arm that may be secured at more than one height, and at least one tether for connecting to at least one of the first and second distal ends of the elongated shaft respectively via at least one of the first attachment mechanism and second attachment mechanism.

* * * * *